US011192753B2

(12) United States Patent
Geng

(10) Patent No.: US 11,192,753 B2
(45) Date of Patent: Dec. 7, 2021

(54) REMOTE TRIGGERING DEVICE, GOVERNOR ASSEMBLY AND ELEVATOR

(71) Applicant: Otis Elevator Company, Farmington, CT (US)

(72) Inventor: Meng Geng, Shanghai (CN)

(73) Assignee: OTIS ELEVATOR COMPANY, Farmington, CT (US)

( * ) Notice: Subject to any disclaimer, the term of this patent is extended or adjusted under 35 U.S.C. 154(b) by 518 days.

(21) Appl. No.: 16/235,341

(22) Filed: Dec. 28, 2018

(65) Prior Publication Data

US 2019/0202664 A1 Jul. 4, 2019

(30) Foreign Application Priority Data

Dec. 28, 2017 (CN) ..... 201711455593.0

(51) Int. Cl.
*B66B 5/04* (2006.01)

(52) U.S. Cl.
CPC ..... *B66B 5/044* (2013.01); *B66B 5/048* (2013.01)

(58) Field of Classification Search
CPC B66B 5/04; B66B 5/044; B66B 5/046; B66B 5/048
See application file for complete search history.

(56) References Cited

U.S. PATENT DOCUMENTS 5,183,978 A 2/1993 Sheridan et al.
7,077,246 B2 7/2006 Timtner
7,650,969 B2 1/2010 Monzon et al.
7,699,145 B2 4/2010 Ericson
8,720,262 B2 5/2014 Windlin
2011/0272223 A1 11/2011 Drayer et al.
(Continued)

FOREIGN PATENT DOCUMENTS

CN 206266033 U 6/2017
CN 106986249 A 7/2017
CN 105293247 A 11/2017
(Continued)

OTHER PUBLICATIONS

European Search Report for application 18215158.9, dated Jun. 3, 2019, 7 pages.
(Continued)

*Primary Examiner* — Minh Truong
(74) *Attorney, Agent, or Firm* — Cantor Colburn LLP

(57) ABSTRACT

A remote trigger apparatus includes: an actuator; and a pivoting member rotatable around an axis, wherein the actuator enables the pivoting member to rotate from an idle position to an operating position, in the idle position, the pivoting member keeps separate from a centrifugal mechanism of the governor component, in the operating position, the pivoting member is jointed to a contact part of the centrifugal mechanism of the governor component, and the pivoting member further rotates along with the centrifugal mechanism and radially pushes the contact part inward, so as to trigger the governor component. In the remote trigger apparatus according to an embodiment of the present invention, the pivoting member guides the centrifugal mechanism gradually and gently, thus avoiding direct impacts on the centrifugal mechanism of the governor component and problems caused by the direct impacts.

18 Claims, 4 Drawing Sheets

(56) References Cited

U.S. PATENT DOCUMENTS

| | | | |
|---|---|---|---|
| 2013/0098711 | A1 | 4/2013 | Aguado et al. |
| 2017/0190545 | A1 | 7/2017 | Dube et al. |

FOREIGN PATENT DOCUMENTS

| | | | | | |
|---|---|---|---|---|---|
| CN | 111377329 | A | * | 7/2020 | ..... B66B 5/044 |
| DE | 3406633 | A1 | | 9/1984 | |
| EA | 201700417 | A1 | * | 1/2019 | ..... B66B 5/04 |
| EP | 0121711 | A2 | | 4/1988 | |
| EP | 0662445 | A2 | | 7/1995 | |
| EP | 1742345 | A1 | | 1/2007 | |
| EP | 2258650 | A2 | | 12/2010 | |
| EP | 1893516 | B1 | | 4/2013 | |
| JP | 3929724 | B2 | | 6/2007 | |
| JP | 4437574 | B2 | | 3/2010 | |
| KR | 20050004395 | A | | 1/2005 | |
| KR | 20170033668 | A | | 3/2017 | |
| WO | WO-2010046489 | A1 | * | 4/2010 | ..... B66B 5/044 |

OTHER PUBLICATIONS

Hollister-Whitney Elevator Corporation, "Governor Testing Instructions, For Use with All 201, 202, 207, 207RS, 208, & 210 Governor Models", Mar. 16, 2016, 10 pages.

* cited by examiner

REMOTE TRIGGERING DEVICE, GOVERNOR ASSEMBLY AND ELEVATOR

FOREIGN PRIORITY

This application claims priority to Chinese Patent Application No. 201711455593.0, filed Dec. 28, 2017, and all the benefits accruing therefrom under 35 U.S.C. § 119, the contents of which in its entirety are herein incorporated by reference.

TECHNICAL FIELD

The present invention relates to the field of elevator governor technologies, and in particular, to a remote trigger apparatus for a governor component, a governor component, and an elevator.

BACKGROUND ART

With the development of governor component technologies for elevators, novel Car Mounted Governor (CMG) components are more widely applied. Compared with the conventional governor components with or without a machine room, the CMG component has a more compact structure. The US Patent Publication No. US2013/0098711A1 published by Aguado et al. on 25 Apr. 2013 disclosed a governor component. In the governor component, a centrifugal mechanism rotating together with a sheave is triggered when the rotational speed of the sheave exceeds a certain value, such that the sheave drives a core ring associated with a safety apparatus to rotate, thus triggering the governor component, including triggering a safety switch to stop supplying power and enabling mechanical friction between the safety apparatus and a rail to brake a car. In such a CMG component, the governor component further includes a remote trigger apparatus. The remote trigger apparatus can be controlled actively to act on the centrifugal mechanism, such that the governor component can be triggered actively without stalling the car, for a purpose of, e.g., testing. The existing remote trigger apparatus is mainly formed by an electromagnet, and a tail end of a protruded post when the electromagnet is triggered directly acts on the centrifugal mechanism that is generally made of plastic.

In conventional applications, the CMGs are generally applied to low-speed elevators. The Chinese Utility Model Patent No. ZL201621141734.2 filed by the OTIS Elevator Company and entitled "REMOTE TRIGGER APPARATUS, GOVERNOR COMPONENT, AND ELEVATOR" discloses a remote trigger apparatus. In the remote trigger apparatus, a contact part having a smooth transitional surface is adopted to attempt to apply a CMG to a high-speed elevator. The patent is incorporated herein by reference in its entirety.

SUMMARY OF THE INVENTION

The present invention aims at solving or at least alleviating the problems existing in the prior art.

According to one aspect of the present invention, a remote trigger apparatus for a governor component is provided, the remote trigger apparatus including: an actuator; and a pivoting member rotatable around an axis, wherein the actuator enables the pivoting member to rotate from an idle position to an operating position, in the idle position, the pivoting member keeps separate from a centrifugal mechanism of the governor component, in the operating position, the pivoting member is jointed to a contact part of the centrifugal mechanism of the governor component, and the pivoting member further rotates along with the contact part of the centrifugal mechanism and radially pushes the contact part inward, so as to trigger the governor component.

Optionally, in the remote trigger apparatus, when the governor component is triggered, the pivoting member is in surface contact with the contact part of the centrifugal mechanism.

Optionally, in the remote trigger apparatus, the pivoting member has an arc-shaped contact surface.

Optionally, in the remote trigger apparatus, the pivoting member has a semicircular receiving port that matches the outer circumferential shape of the contact part of the centrifugal mechanism.

Optionally, in the remote trigger apparatus, the governor component is triggered when a rotating center of the pivoting member, a curvature center of the semicircular receiving port of the pivoting member (the same as a center of the contact part of the governor component when being triggered), and a rotating center of the governor component are collinear.

Optionally, in the remote trigger apparatus, the remote trigger apparatus further includes a reset spring tending to enable the pivoting member to return to the idle position.

Optionally, in the remote trigger apparatus, the reset spring is a tension spring, a first end of the tension spring is fixed, and a second end of the tension spring is connected to the pivoting member.

Optionally, in the remote trigger apparatus, the pivoting member includes: a pivotal axis fixedly connected to a governor rack; and a pivoting plate, wherein a first end of the pivoting plate is rotatably connected to the pivotal axis, a second end of the pivoting plate has a semicircular receiving port used to be jointed to the contact part, and the pivoting plate is pulled by the tension spring to be kept in the idle position.

Optionally, in the remote trigger apparatus, the actuator is an electromagnet that can perform linear displacement and act on a back side of the pivoting plate to push the pivoting plate to rotate from the idle position to the operating position.

In another aspect, a governor component is provided, including: a sheave, a centrifugal mechanism and a safety apparatus that are associated with the sheave, and a remote trigger apparatus, including: an actuator; and a pivoting member rotatable around an axis, wherein the actuator enables the pivoting member to rotate from an idle position to an operating position, in the idle position, the pivoting member keeps separate from a centrifugal mechanism of the governor component, in the operating position, the pivoting member is jointed to a contact part of the centrifugal mechanism of the governor component, and the pivoting member further rotates along with the contact part of the centrifugal mechanism and radially pushes the contact part inward, so as to trigger the governor component.

Optionally, in the governor component, when the governor component is triggered, the pivoting member is in surface contact with the contact part of the centrifugal mechanism.

Optionally, in the governor component, the pivoting member has an arc-shaped contact surface.

Optionally, in the governor component, the pivoting member has a semicircular receiving port that matches the outer circumferential shape of the contact part of the centrifugal mechanism.

Optionally, in the governor component, the centrifugal mechanism includes centrifugal block brackets and linking rods connected between the centrifugal block brackets, and the contact part of the centrifugal mechanism is a linking rod joint between the linking rod and the centrifugal block bracket.

Optionally, in the governor component, the governor component is configured such that a distance LC from a rotating center of the pivoting member to a rotating center of the governor component equals to a sum of a distance LA from the rotating center of the pivoting member to a curvature center of the semicircular receiving port of the pivoting member and a distance LB from the rotating center of the governor component when the governor component is triggered to a center of the contact part of the centrifugal mechanism.

Optionally, in the governor component, the governor component is triggered when a rotating center of the pivoting member, a curvature center of the semicircular receiving port of the pivoting member (the same as a center of the contact part of the governor component when being triggered), and a rotating center of the governor component are collinear.

Optionally, in the governor component, the remote trigger apparatus further includes a reset spring tending to enable the pivoting member to return to the idle position.

Optionally, in the governor component, the reset spring is a tension spring, a first end of the tension spring is fixed, and a second end of the tension spring is connected to the pivoting member.

Optionally, in the governor component, the pivoting member includes:

a pivotal axis fixedly connected to a governor rack; and a pivoting plate, wherein a first end of the pivoting plate is rotatably connected to the pivotal axis, a second end of the pivoting plate has a semicircular receiving port used to be jointed to the contact part, and the pivoting plate is pulled by the tension spring to be kept in the idle position.

Optionally, in the governor component, the actuator is an electromagnet that can perform linear displacement and act on a back side of the pivoting plate to push the pivoting plate to rotate from the idle position to the operating position.

Optionally, in the governor component, the governor component is a car mounted governor component.

In another aspect, an elevator is provided. The elevator includes the governor component according to various embodiments.

When being triggered, the remote trigger apparatus according to the present invention has smaller impacts on the centrifugal mechanism and has no impacts on the actuator.

BRIEF DESCRIPTION OF THE DRAWINGS

Contents disclosed in the present invention will become more comprehensible with reference to accompanying drawings. It is easy to understand by those skilled in the art that: these accompanying drawings are for illustrative purposes only, instead of limiting the protection scope of the present invention. Moreover, similar numerals in the drawings are used to represent similar components, wherein.

DETAILED DESCRIPTION

It is easy to understand that those of ordinary skill in the art can propose various interchangeable structure modes and implementation manners according to the technical solutions of the present invention without changing the essential spirit of the present invention. Therefore, the following specific implementation manners and the accompanying drawings are merely exemplary illustrations of the technical solutions of the present invention and should not be construed as all of the present invention or construed as defining or limiting the technical solutions of the present invention.

Orientation terms such as up, down, left, right, front, rear, front side, back side, top, and bottom that are mentioned or may be mentioned in the specification are defined with respect to constructions shown in the accompanying drawings. They are relative concepts, and therefore, they may correspondingly change according to different positions and different use states thereof. As a result, these or other orientation terms should not be construed as limitative terms.

Figure 1:
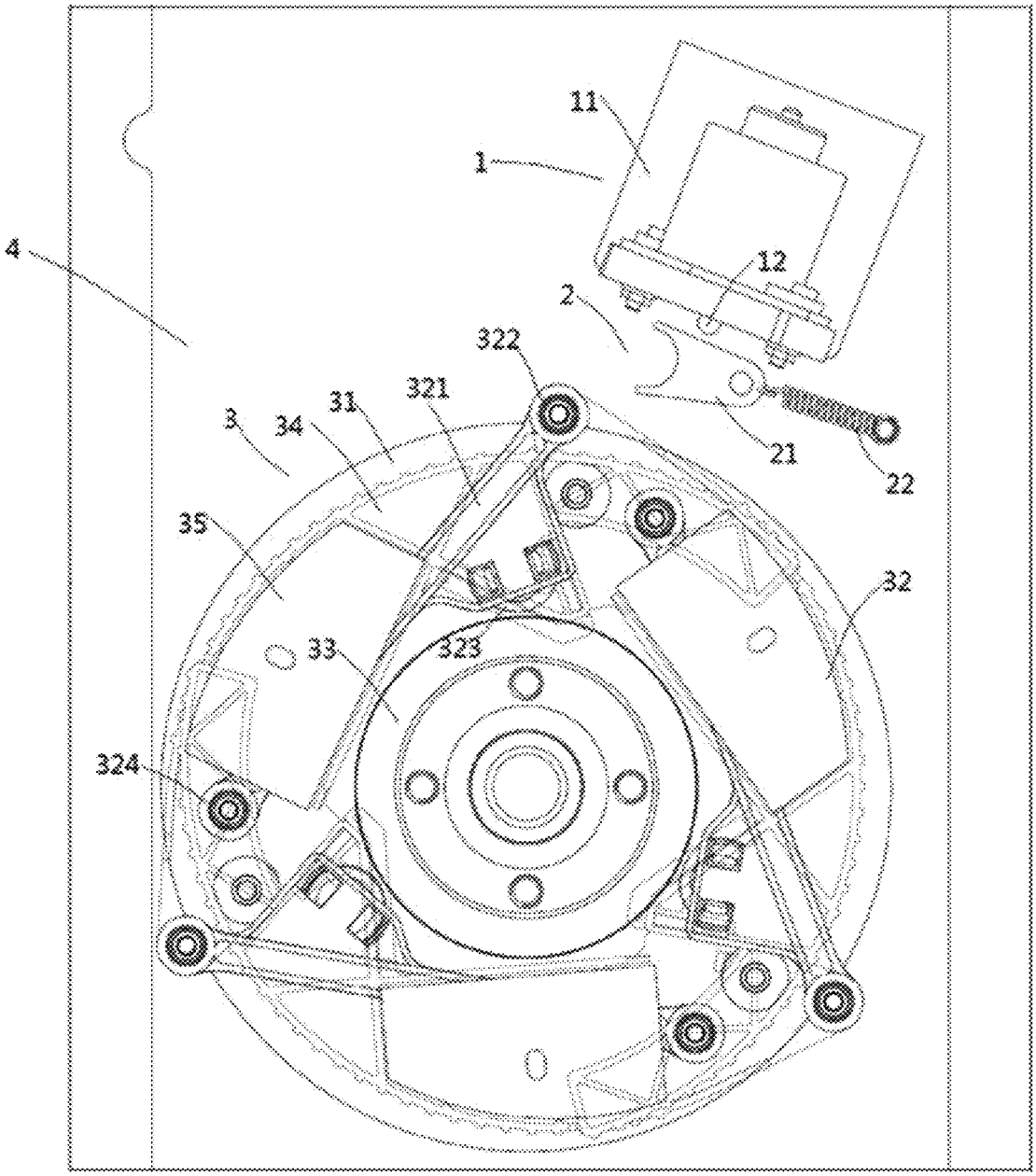
FIG. 1 is a schematic view of a governor component according to an embodiment, wherein a remote trigger apparatus is in an idle position.

First, referring to FIG. 1, a schematic view of an embodiment of a governor component according to the present invention is shown. It should be noted that in FIG. 1, FIG. 4, and FIG. 5 in the accompanying drawings of the specification, a centrifugal block bracket 34 is shown as transparent to show an internal structure of a centrifugal mechanism. It should be noted that the present invention is mainly directed to a remote trigger apparatus for a governor component, and therefore, a part of other components of the governor component are omitted or are not depicted and described in detail, and these parts can use designs that are well known by those skilled in the art. The detailed introduction of a CMG component can be obtained with reference to the US Patent Publication No. US2013/0098711 A1 published by Aguado et al. on 25 Apr. 2013, which is incorporated herein by reference in its entirety. Although embodiments of the present invention use specific CMG components as examples, it is easily conceived of by those skilled in the art that remote trigger apparatuses according to the embodiments of the present invention can be used in various types of governor components, and these modified governor components should be considered as falling within the scope of the present invention.

Figure 5:
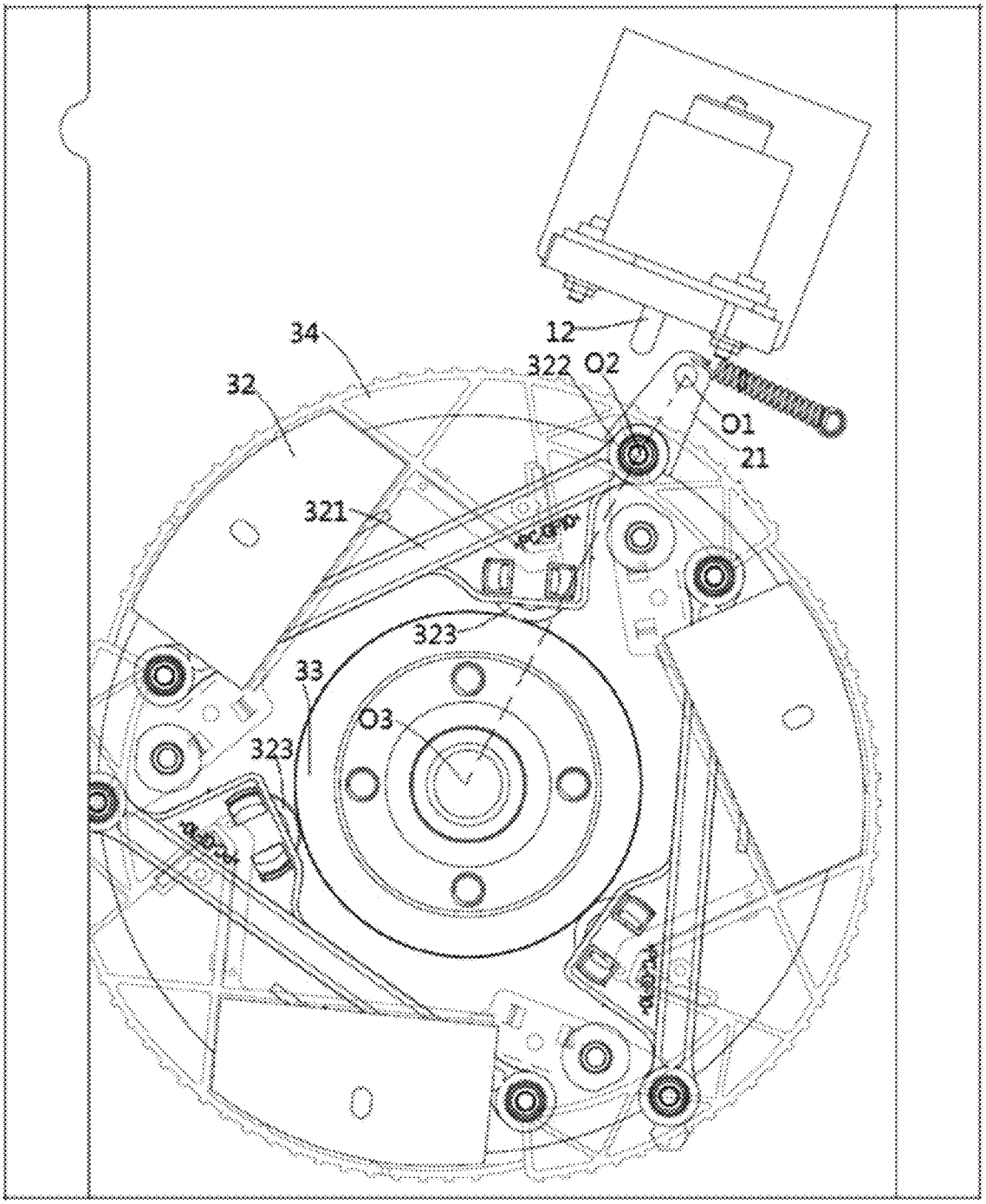
FIG. 5 is a schematic view of a governor component according to an embodiment, wherein the governor component is triggered.

As shown in FIG. 1, the overall governor component is mounted on a rack 4. The governor component includes a sheave 31 and a centrifugal mechanism 32. The centrifugal mechanism 32 is linked to the sheave 31 to rotate together with the sheave 31 at an angular speed corresponding to the operating speed of a car and in a direction corresponding to an operating direction of the car. The centrifugal mechanism 32 includes multiple, e.g., three centrifugal block brackets 34. Each centrifugal block bracket 34 is provided with a centrifugal block 35, such as a metal weight. A linking rod 321 is disposed between the centrifugal block brackets 34, and two ends 322, 324 of the linking rod 321 are connected to two adjacent centrifugal block brackets 34, respectively. An elastic apparatus or a magnetic apparatus (not shown) is further disposed between the centrifugal block brackets 34, such that the centrifugal mechanism 32 in a non-operating state is located in a contraction position shown in FIG. 1. When the operating speed of the car is overlarge, due to the increased centrifugal force, the centrifugal forced applied to each centrifugal block bracket 34 overcomes the tightening force of the elastic apparatus or the magnetic apparatus such that the centrifugal mechanism 32 is opened to a spread position, as shown in FIG. 5. In this process, the centrifugal block bracket 34 can trigger a safety switch that keeps a distance away from the centrifugal mechanism 32 to stop supplying power to the elevator. When the centrifugal mechanism is opened to the spread position, a wheel 323 on the centrifugal mechanism 32 and located at the inner side of the linking rod 321 is jointed to a core ring 33 such that the core ring 33 is driven to rotate slightly, thus triggering the safety apparatus, such that the safety apparatus such as a safety gear can rub against a rail to brake the elevator car. In some cases, for example, for the purpose of testing, it is expected that the governor component is triggered actively when the elevator car is not stalled, and therefore, the governor component is generally provided with a remote trigger apparatus that can trigger the governor component actively in response to a control switch located in an elevator control room.

Figure 2:
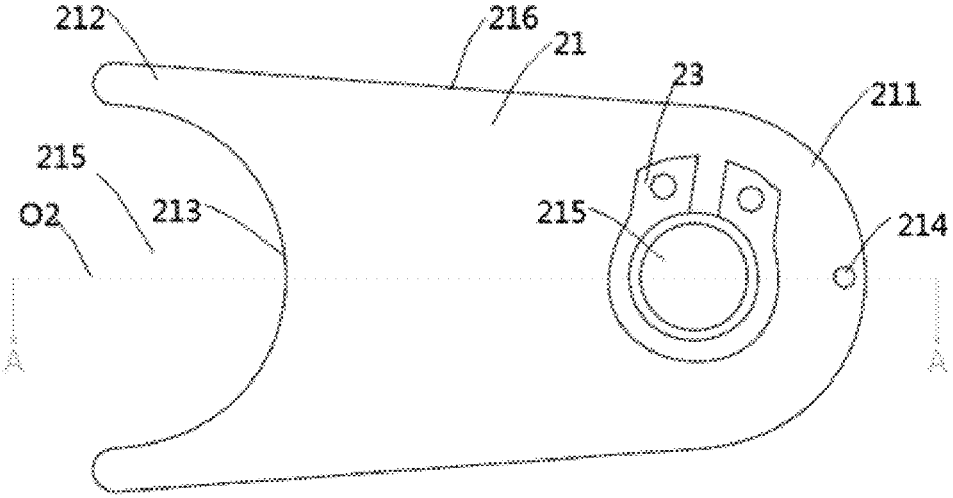
FIG. 2 is a front view of a pivoting member according to an embodiment.
Figure 3:
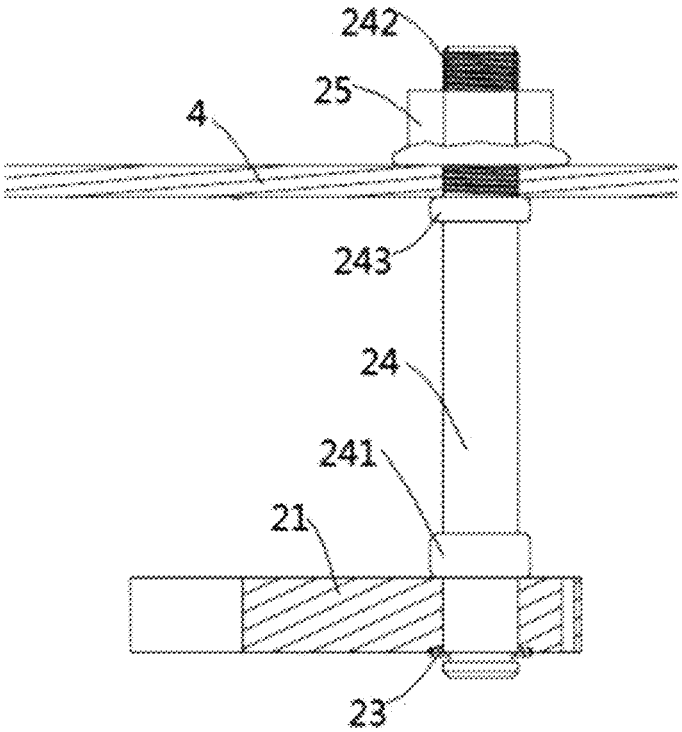
FIG. 3 is a sectional view of a pivoting member along A-A according to an embodiment.

In the embodiment of FIG. 1, the remote trigger apparatus includes an actuator 1 and a pivoting member 2. The actuator 1 can move, e.g., linearly or in other types such as rotationally, in response to a remote-control switch. The embodiment of FIG. 1 shows a specific embodiment of the actuator 1. The actuator 1 is formed by an electromagnet, including an electromagnet body 11 and an operating end 12. The operating end 12 can move linearly in response to whether the electromagnet 11 is electrified. In an alternative embodiment, another type of apparatus can be selected as the actuator 1, and an arrangement manner thereof is also changeable. The remote trigger apparatus further includes a pivoting member 2. The pivoting member 2 is rotatable around an axis perpendicular to a plane of the governor rack and can trigger a governor component by pivoting. Referring to FIG. 2 and FIG. 3, a specific embodiment of the pivoting member 2 is shown. For example, the pivoting member 2 can include a pivotal axis 24 and a pivoting plate 21. The pivotal axis 24 is fixedly connected to the rack 4. The pivotal axis 24 is arranged to be perpendicular to the governor plane, and the governor plane generally refers to a plane parallel to a governor sheave or the governor rack. In some embodiments, the pivotal axis 24 can be provided with a threaded portion 242 and a first shoulder 243. The threaded portion 242 of the pivotal axis 24 can be inserted into an opening in the rack 4 and then received by a nut 25 at the back side of the rack 4, so as to fixedly connect the pivotal axis 24 to the rack 4. The pivoting plate 21 can be provided with a first end 211 and a second end 212. The first end 211 of the pivoting plate 21 is rotatably connected to the pivotal axis 24. For example, the first end 211 of the pivoting plate 21 can be provided with an opening 215, and the pivoting plate 21 is fitted on the pivotal axis 24 through the opening 215 and is rotatably positioned on the pivotal axis 24 by using a second shoulder 241 on the pivotal axis 24 and a clamp ring 23.

Figure 4:
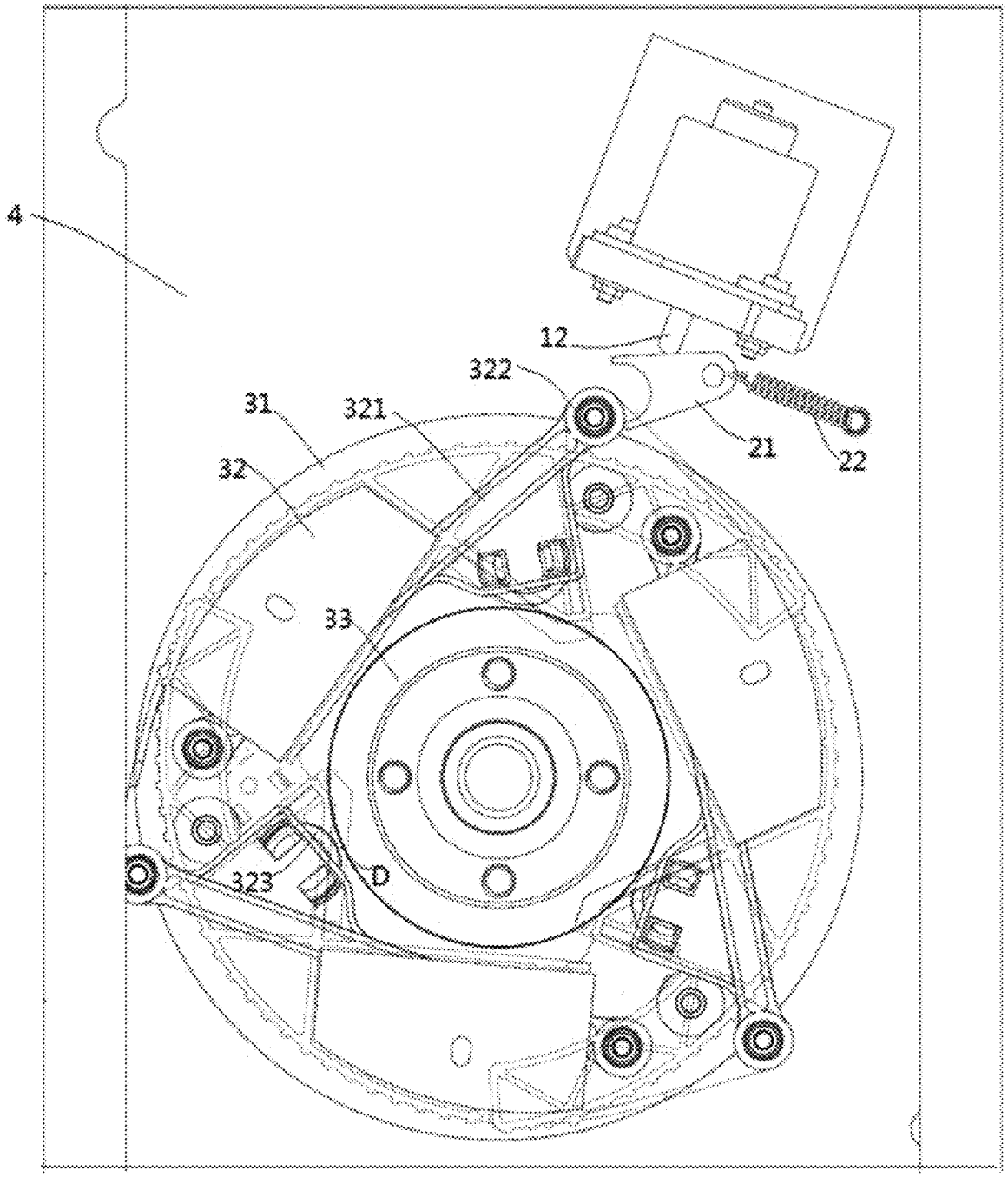
FIG. 4 is a schematic view of a governor component according to an embodiment, wherein a remote trigger apparatus is in an operating position.

Referring to FIG. 1, FIG. 4, and FIG. 5, working principles of the remote trigger apparatus according to the embodiments of the present invention are described. In the state shown in FIG. 1, the pivoting member 2 is in an idle position. In this position, when a sheave 3 rotates, the pivoting member 2 keeps separate from the centrifugal mechanism 32 of the governor component. As shown in FIG. 4, the actuator 1 enables the pivoting member 2 to move from the idle position to an operating position shown in FIG. 4. In some embodiments, the actuator 1 can promote the pivoting member 2 to rotate by a first angle, so as to approach the centrifugal mechanism 32 of the governor component. For example, in the illustrated embodiment, the operating end 12 of the actuator 1 acts on a back side 216 of the pivoting plate 21 to promote the pivoting plate 21 to overcome the tensile force of the tension spring 22 and then rotate by the first angle to the operating position shown in FIG. 4. In the operating position, the second end 212 of the pivoting plate 21 is jointed to the contact part of the centrifugal mechanism of the governor component. In the illustrated embodiment, the contact part of the centrifugal mechanism is a linking rod joint 322 of the linking rod 321. After the pivoting member 2 is jointed to the contact part 322 of the centrifugal mechanism, the pivoting member 2 further rotates along with the contact part 322, and radially pushes the contact part 322 inward (toward a rotating center O3 of the sheave), thus triggering the governor component. For example, in a CMG, the pivoting member 2 pushes the linking rod joint 322, such that the linking rod 321 is rotated and a roller 323 at the inner side of the linking rod 321 is jointed to the core ring 33 to drive the core ring 33 to rotate and pull the safety gear to brake the elevator car. In an alternative embodiment, the centrifugal mechanism 32 can have another structure, as long as the rotation of the pivoting member 2 pushing the contact part 322 can trigger the centrifugal mechanism of the governor component. After passing the triggering position shown in FIG. 5, as the centrifugal mechanism 32 further rotates, the contact part 322 can be detached from the pivoting member 2, and the governor component has been triggered. Therefore, there will be no rigid collision between the pivoting member 2 and the centrifugal mechanism 32, as a result, even if the governor component rotates at a high speed and the centrifugal mechanism has large rotational inertia, the joint of the pivoting member 2 and the centrifugal mechanism 32 will not damage the pivoting member 2 or the centrifugal mechanism 32. Therefore, the remote trigger apparatus and the governor component according to the embodiment of the present invention are applicable to high-speed elevators with governors having large rotational inertia.

As shown in FIG. 5, when the governor component is triggered, the pivoting member 2 is in surface contact with the contact part 322 of the centrifugal mechanism 32, and this further disperses the impact force when the governor is triggered, such that the centrifugal mechanism and the actuator are less impacted. In some embodiments, the pivoting member 2 can define an arc-shaped contact surface 213. In some embodiments, the pivoting member 2 can be provided with a semicircular receiving port 215 with a curvature center O2, and the semicircular receiving port matches the outer circumferential shape of the linking rod joint of the centrifugal mechanism of the governor component.

As shown in FIG. 5, in some embodiments, the governor component can be configured such that a distance LC from a rotating center O1 of the pivoting member 2 to a rotating center O3 of the governor component equals to a sum of a distance LA from the rotating center O1 of the pivoting member to a curvature center O2 of the semicircular receiving port of the pivoting member and a distance LB from the rotating center O3 of the governor component when the governor component is triggered to a center of the linking rod joint of the centrifugal mechanism, i.e., LC=LA+LB. in some embodiments, the governor component is triggered when the rotating center O1 of the pivoting member 2, the curvature center O2 of the semicircular receiving port of the pivoting member 2, and the rotating center O3 of the governor component are collinear.

In some embodiments, the pivoting member 2 can include a reset spring. The reset spring tends to enable the pivoting member to return to the idle position. In some embodiments, the reset spring can be a tension spring 22. A first end of the tension spring 22 is fixed, for example, fixedly connected to the rack 4. A second end of the tension spring 22 is connected to the pivoting member 2. For example, the second end of the tension spring is formed into a hook and is connected into an aperture 214 at the first end 211 of the pivoting plate 21. In an alternative embodiment, another form of reset spring can also be used, for example, a reset spring in a coil spring form arranged on the pivotal axis.

The present invention further provides a governor component. The governor component includes the remote trigger apparatus according to each embodiment of the present invention.

The present invention further provides an elevator system. The elevator system includes the governor component according to each embodiment of the present invention.

It should be understood that the actuator in the remote trigger apparatus according to the embodiment of the present invention is not limited to the electromagnet, which can be any apparatus that can perform displacement to move the pivoting member to the operating position. In addition, in the embodiment of the present invention, the pivoting member is rotated from the idle position to the operating position under the effect of the actuator. In an alternative embodiment, the pivoting member can, for example, translate along a direction perpendicular to the governor plane under the effect of the actuator, so as to move from the idle position that is axially staggered from the contact part to the operating position that is axially aligned with the contact part of the centrifugal mechanism. Moreover, in the embodiment of the present invention, the contact part of the centrifugal mechanism is, for example, the linking rod joint, and in another type of governor, the contact part can be another suitable part of the centrifugal mechanism, as long as the governor component can be triggered when the pivoting member radially pushes the contact part inward.

It should be understood that all above preferred embodiments are exemplary rather than limited. Various modifications or deformations made on the above-described specific embodiments by those skilled in the art under the conception of the present invention shall all fall within the protection scope of the present invention.

What is claimed is:

1. A remote trigger apparatus for a governor component, comprising:

an actuator; and a pivoting member rotatable around an axis perpendicular to a governor plane, wherein the actuator enables the pivoting member to rotate from an idle position to an operating position, in the idle position, the pivoting member keeps separate from a centrifugal mechanism of the governor component, in the operating position, the pivoting member is jointed to a contact part of the centrifugal mechanism of the governor component, and the pivoting member further rotates along with the contact part of the centrifugal mechanism and radially pushes the contact part inward, so as to trigger the governor component, wherein the pivoting member has a semicircular receiving port that matches the outer circumferential shape of the contact part of the centrifugal mechanism, and wherein the governor component is triggered when a rotating center of the pivoting member, a curvature center of the semicircular receiving port of the pivoting member, and a rotating center of the governor component are collinear.

2. The remote trigger apparatus according to claim 1, characterised in that when the governor component is triggered, the pivoting member is in surface contact with the contact part of the centrifugal mechanism.

3. The remote trigger apparatus according to claim 1, characterised in that the pivoting member has an arc-shaped contact surface.

4. The remote trigger apparatus according to claim 1, further comprising a reset spring tending to enable the pivoting member to return to the idle position.

5. The remote trigger apparatus according to claim 4, characterised in that the reset spring is a tension spring, a first end of the tension spring is fixed, and a second end of the tension spring is connected to the pivoting member.

6. The remote trigger apparatus according to claim 1, characterised in that the pivoting member comprises:

a pivotal axis fixedly connected to a governor rack; and a pivoting plate, wherein a first end of the pivoting plate is rotatably connected to the pivotal axis, a second end of the pivoting plate has the semicircular receiving port used to be jointed to the contact part, and the pivoting plate is pulled by a tension spring to be kept in the idle position.

7. The remote trigger apparatus according to claim 6, characterised in that the actuator is an electromagnet that can perform linear displacement and act on a back side of the pivoting plate to push the pivoting plate to rotate from the idle position to the operating position.

8. A governor component, comprising: a sheave, a centrifugal mechanism and a safety apparatus that are associated with the sheave, and a remote trigger apparatus, comprising:

an actuator; and a pivoting member rotatable around an axis perpendicular to a governor plane, wherein the actuator enables the pivoting member to rotate from an idle position to an operating position, in the idle position, the pivoting member keeps separate from a centrifugal mechanism of the governor component, in the operating position, the pivoting member is jointed to a contact part of the centrifugal mechanism of the governor component, and the pivoting member further rotates along with the contact part of the centrifugal mechanism and radially pushes the contact part inward, so as to trigger the governor component, wherein the pivoting member has a semicircular receiving port that matches the outer circumferential shape of the contact part of the centrifugal mechanism, and wherein the governor component is triggered when a rotating center of the pivoting member, a curvature center of the semicircular receiving port of the pivoting member, and a rotating center of the governor component are collinear.

9. The governor component according to claim 8, characterised in that when the governor component is triggered, the pivoting member is in surface contact with the contact part of the centrifugal mechanism.

10. The governor component according to claim 8, characterised in that the pivoting member has an arc-shaped contact surface.

11. The governor component according to claim 8, characterised in that the centrifugal mechanism includes centrifugal block brackets and linking rods connected between the centrifugal block brackets, and the contact part of the centrifugal mechanism is a linking rod joint between the linking rod and the centrifugal block bracket.

12. The governor component according to claim 8, characterised in that the governor component is configured such that a distance LC from a rotating center of the pivoting member to the rotating center of the governor component equals to a sum of a distance LA from the rotating center of the pivoting member to the curvature center of the semicircular receiving port of the pivoting member and a distance LB from the rotating center of the governor component when the governor component is triggered to a center of the contact part of the centrifugal mechanism.

13. The governor component according to claim 8, characterised in that the remote trigger apparatus further comprises a reset spring tending to enable the pivoting member to return to the idle position.

14. The governor component according to claim 13, characterised in that the reset spring is a tension spring, a first end of the tension spring is fixed, and a second end of the tension spring is connected to the pivoting member.

15. The governor component according to claim 8, characterised in that the pivoting member comprises:

a pivotal axis fixedly connected to a governor rack; and a pivoting plate, wherein a first end of the pivoting plate is rotatably connected to the pivotal axis, a second end of the pivoting plate has the semicircular receiving port used to be jointed to the contact part, and the pivoting plate is pulled by a tension spring to be kept in the idle position.

16. The governor component according to claim 15, characterised in that the actuator is an electromagnet that can perform linear displacement and act on a back side of the pivoting plate to push the pivoting plate to rotate from the idle position to the operating position.

17. The governor component according to claim 8, characterised in that the governor component is a car mounted governor component.

18. An elevator, comprising the governor component according to claim 8.

* * * * *